US005549433A

United States Patent [19]

Byrne

[11] Patent Number: 5,549,433

[45] Date of Patent: Aug. 27, 1996

[54] BINDING EQUIPMENT

[76] Inventor: Rodger J. Byrne, Niederdonkerstrasse 103, 40667 Meerbusch, Germany

[21] Appl. No.: 306,740

[22] Filed: Sep. 15, 1994

[51] Int. Cl.[6] ..... B42B 5/10

[52] U.S. Cl. ..... 412/39; 412/33

[58] Field of Search ..... 412/39, 38, 40, 412/33, 9

[56] References Cited

U.S. PATENT DOCUMENTS

| | | | |
|---|---|---|---|
| 3,945,073 | 3/1976 | Adams | 412/39 |
| 5,273,387 | 12/1993 | Groswixth, II et al. | 412/38 X |
| 5,431,519 | 7/1995 | Baumann | 412/38 X |

FOREIGN PATENT DOCUMENTS

| | | | |
|---|---|---|---|
| 529897 | 3/1993 | European Pat. Off. | 412/39 |

OTHER PUBLICATIONS

"regur Holix—Lochner nach Mass—" (regur Holix—paper punch to measure).

"RENZ—Binden und Kaschieren mit System" (Binding and Laminating with System).

*Primary Examiner*—Willmon Fridie, Jr.

*Attorney, Agent, or Firm*—Jordan & Hamburg

[57] ABSTRACT

Apparatus for binding a plurality of sheets having aligned holes with a binding wire includes two bending elements which are pivotably connected to one another, one of the bending elements having a recess for partially accommodating the binding wire, the other of the bending elements having a projection such that upon placing the binding wire in the recess with the binding wire passing through the holes in the sheets and effecting pivotal movement between the two bending elements, the projection engages and bends the binding wire to thereby effect binding of the plurality of sheets by the binding wire.

24 Claims, 6 Drawing Sheets

BINDING EQUIPMENT

BACKGROUND OF THE INVENTION

The invention relates to equipment for the binding of material, such as a plurality of sheets by means of wire, the wire being passed through coinciding holes of different parts of the material that is to be bound and is then bent, so that it embraces the material to be bound.

From the brochure "regur Holix—Locher nach Mαβ—" (regur Holix—paper punch to measure), paper punches or a punching device is known, which make binding perforations at different intervals possible, so that sheets can be filed in ring binders or organizers. The steel punches are accommodated in a light, robust aluminum housing and are actuated by means of a lever element, which is constructed as easily seizable aluminum plate and pivotably hinged in the housing. The pivoting and, at the same time, the therewith coupled motion of the strip with the individual punches take place against the force of a restoring spring.

Furthermore, from the brochure "RENZ—Binden und Kaschieren mit System" (Binding and Laminating with System), a combined electrical punching and hand-operated closing machine for binding paper sheets into blocks is known. To begin with, the machine is adjusted to the appropriate binding diameter. The material to be bound is then inserted and punched. After that, the material to be bound is suspended in so-called wire, comb-like bindings. The wire, with the block suspended therein, is closed by driving down a closing beam by means of an electric motor, as a result of which the wire, comb-like binding is compressed.

SUMMARY OF THE INVENTION

On the other hand, the invention opens up the possibility of closing the wire, comb-like binding manually without an electric driving mechanism. By pivoting the bending elements against one another, one of them can be used as a pressure lever arm. If such an arm is sufficiently long, the user needs to exert considerable less force. Consequently, there is no need for an electric driving mechanism.

According to a special embodiment of the invention, the projecting and/or inwardly recessed profile and the corresponding, associated bending element is produced in one piece from the same material. Otherwise, the profiles and the in each case associated bending elements can be produced as separate pieces, preferably, however, from the same material.

It is particularly advantageous if the binding equipment is combined with a punching device or a punch. This can be realized particularly by a structural integration with the punching device within the scope of a uniform structural shape and/or within a common housing. In this connection, the bending elements can also be hinged to one another within the structural shape and/or the housing, as a result of which the possibility arises that the hinge axis can clasp the housing compactly.

It is particularly advantageous if at least one of the bending elements is coupled with the movable punching device in such a manner, that the punching device, as well as the binding mechanism can be activated over one and the same actuating means. By these means, it is possible to make do with fewer structural components, less material and less weight, and also to save space. Essential functional components of the punching device (handling means, movement-permitting mechanisms) can additionally be used for the bending mechanism.

A development of the invention aids rapid installation and saves weight. According to this development, the binding equipment is assembled or installed virtually as a modular plug-in system using extruded, profiled aluminum parts. Screws and particularly axles can be omitted, because the profiled aluminum parts can be constructed with beads, which form axles for the hinged parts. The latter are then provided with grooves, complementary to the beads, for accommodating the bead axles.

Within the cavity of a housing, spring elements can be disposed, for example, in the form of steel bow springs, the cone of the arch of which presses against one of the elements that is to be swiveled. This construction, as such, is already known from and employed with the punch of the initially mentioned "regur-Holix" brochure.

Further details, distinguishing features and advantages of the invention arise out of the following description of a preferred embodiment, in conjunction with the drawings.

DESCRIPTION OF THE PREFERRED EMBODIMENTS

Figure 1:
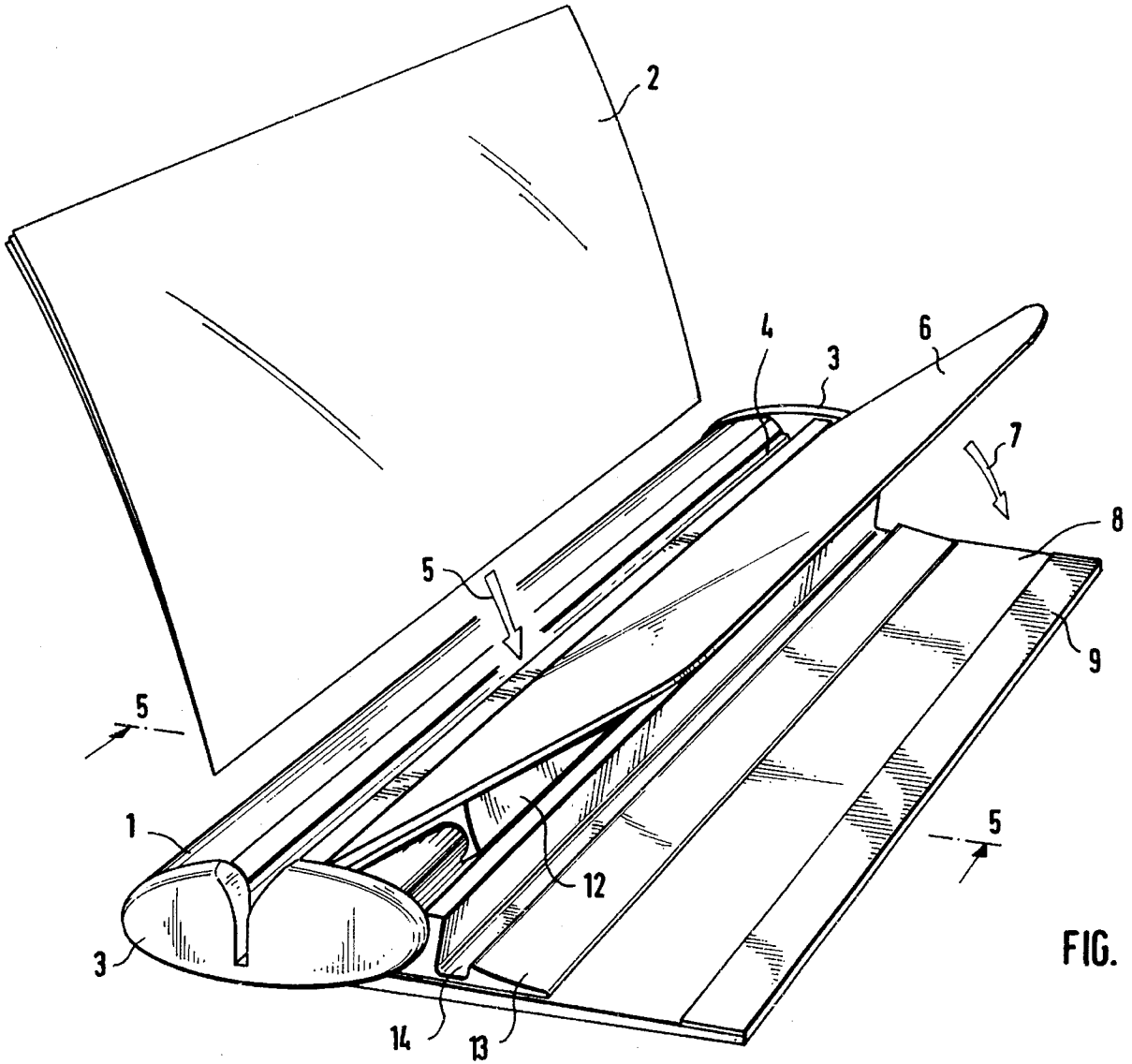
FIG. 1 shows a perspective representation of inventive binding equipment combined with a punching device.

According to FIG. 1, the punching device of the inventive punch and binding equipment has a housing 1 of aluminum, the length of which corresponds approximately to the stack 2 of paper that is to be punched. In cross section, the housing 1 is rounded ovally and covered at its two end faces in each case with plastic caps 3 of appropriate profile. In approximately the center of the upper side, there is a feeding slot 4, into which the stack 2 of paper can be pushed in the feeding direction 5 for punching. The punching mechanism, which operates against the force of a restoring spring, is known as such (compare, for example, the initially mentioned "regur-Holix" brochure) and therefore not drawn or explained in all its detail. An important part of the punching mechanism is formed by the pressure lever plate 6, which is hinged so that it can pivot in the swiveling direction 7 within the housing 1. The swiveling direction 7 is directed downwards onto a base plate 8, which is rigidly fixed to the underside of the housing 1 in the embodiment drawn. At its free edge region, running parallel to the housing 1, the base plate 8 is coated with a magnetic material, such as a glued-on magnetic strip 9. The latter can be used for fixing and holding binding wire (see FIG. 2), which is known as such and in which the perforated paper stack 2 can then be suspended over coinciding holes 11 of the different sheets.

According to FIG. 1, the pressure lever plate 6 is provided on its side facing the bottom plate 8 in the region next to or adjacent to the housing with an approximately L-shaped projecting pressure foot profile 12. The latter is positioned so that it lies opposite an accommodating profile 13, which is fastened to the facing side of the bottom plate 8 also in the immediate vicinity of the housing 1. The accommodating groove 14 forms the essential element of the accommodating profile 13. The length of the accommodating groove 14 corresponds to the length of the paper stack 2 and the width corresponds to the thickness of the sheet stack 2 and/or the diameter or the extent in width of the binding wire 10. In the embodiment drawn, both profiles 12, 13 are formed as separate profiled strips and fastened, for example by gluing, to the mutual facing sides of the pressure lever plate 6 and bottom plate 8.

Figure 2:
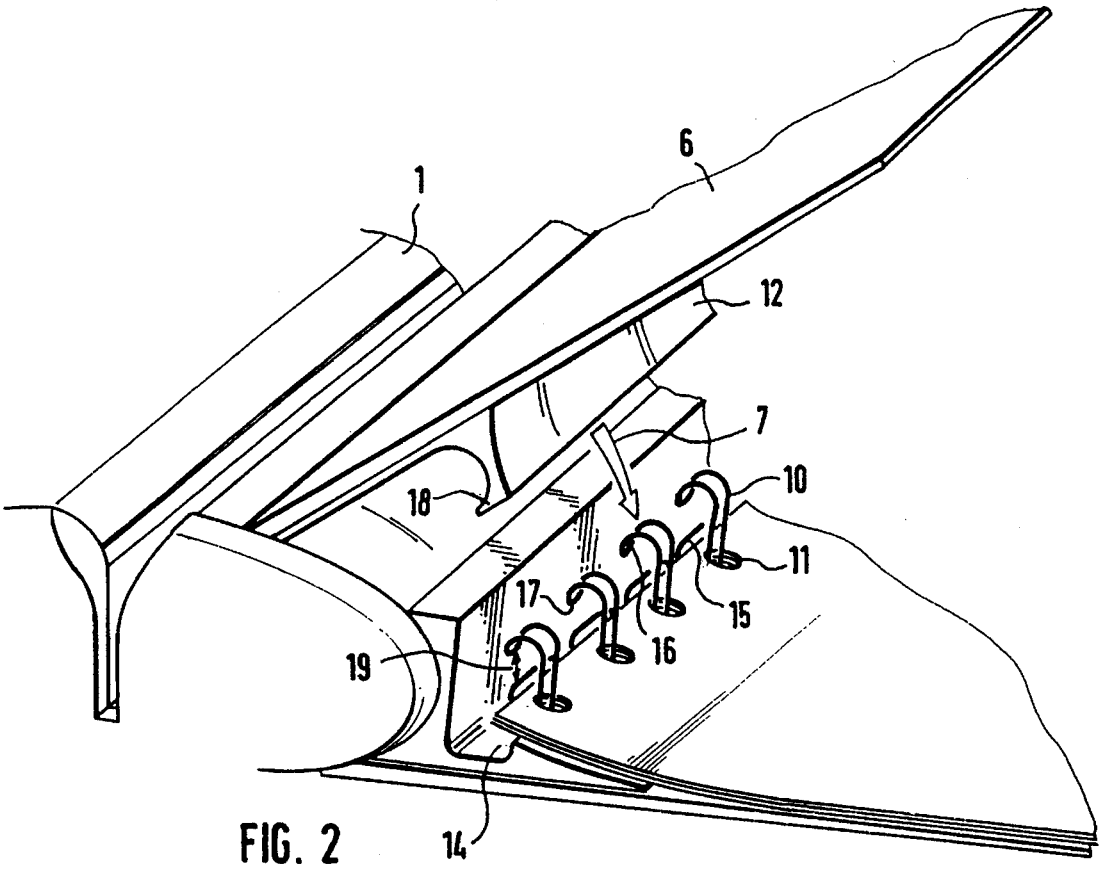
FIG. 2 shows an enlarged section from FIG. 1 with an inserted binding wire and suspended paper.

If the swiveling motion 7 is imparted to the pressure lever plate 6 as in FIG. 2, the pressure foot profile 12 is moved in the direction of the binding wire 10, which—bent in comb-like fashion—is inserted with its broader or longer comb hoop in the accommodating groove 14. The broader comb hoops 15 alternate with the shorter or narrower comb hoops 16, which are pointed with their round apexes or tips 17 in the direction of the free intervals or gaps, which exist between the broader comb hoops 15. Such wire bindings are known as such (compare the initially named RENZ reference).

If the pressure lever plate 6 is increasingly moved in the pivoting direction 7 of FIG. 2, the L-leg end 18 of the pressure foot profile 12 comes up against the narrower comb hoop 16 and presses this into the aforementioned gaps between the broader comb hoops 15. At the same time, the previously open seam 19 of this wire comb binding is closed and the binding of the sheet stack 2 is completed.

Figure 3:
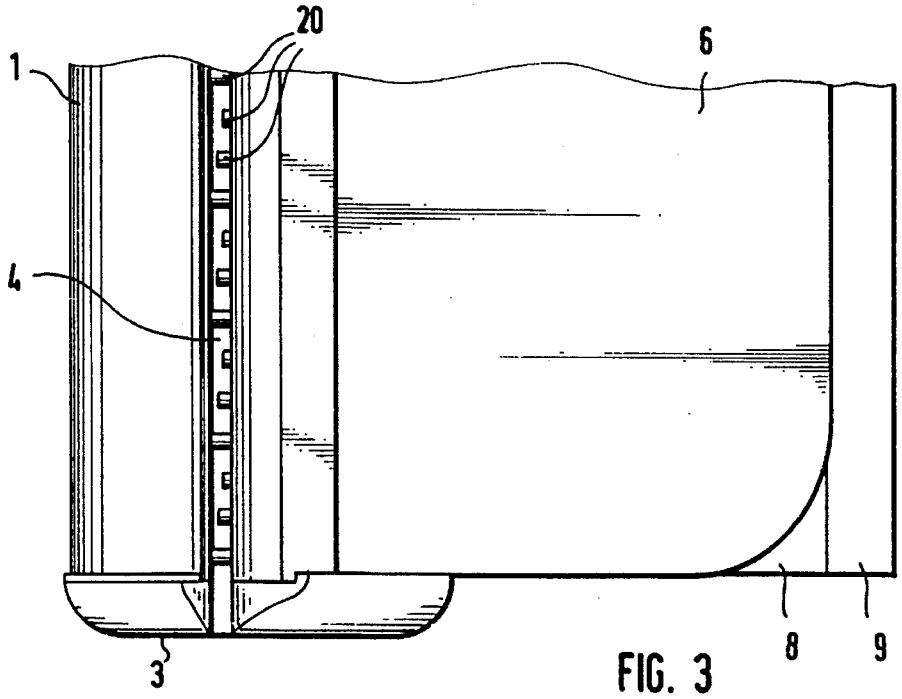
FIG. 3 shows a portion of the inventive, combined binding equipment and punching device in plan view.

In accordance with FIG. 3, the punching mechanism is activated simultaneously with the swiveling 7 of the pressure lever plate 6 and the individual steel punches 20, mutually offset in their longitudinal direction, are induced to penetrate the feeding slot 4 transversely. Pursuant to the invention, the advantage can thus be achieved that punching and binding can be carried out simultaneously, thus saving time. According to FIG. 4, the pieces of paper, punched out, are collected in a waste compartment 21 with a lid 22, which can be opened up on hinges against a spring force. The inner walls of the waste compartment 21 are provided with perforations 23, the diameter and distance between which correspond to the individual punches 20 and which form passages for these.

Figure 4:
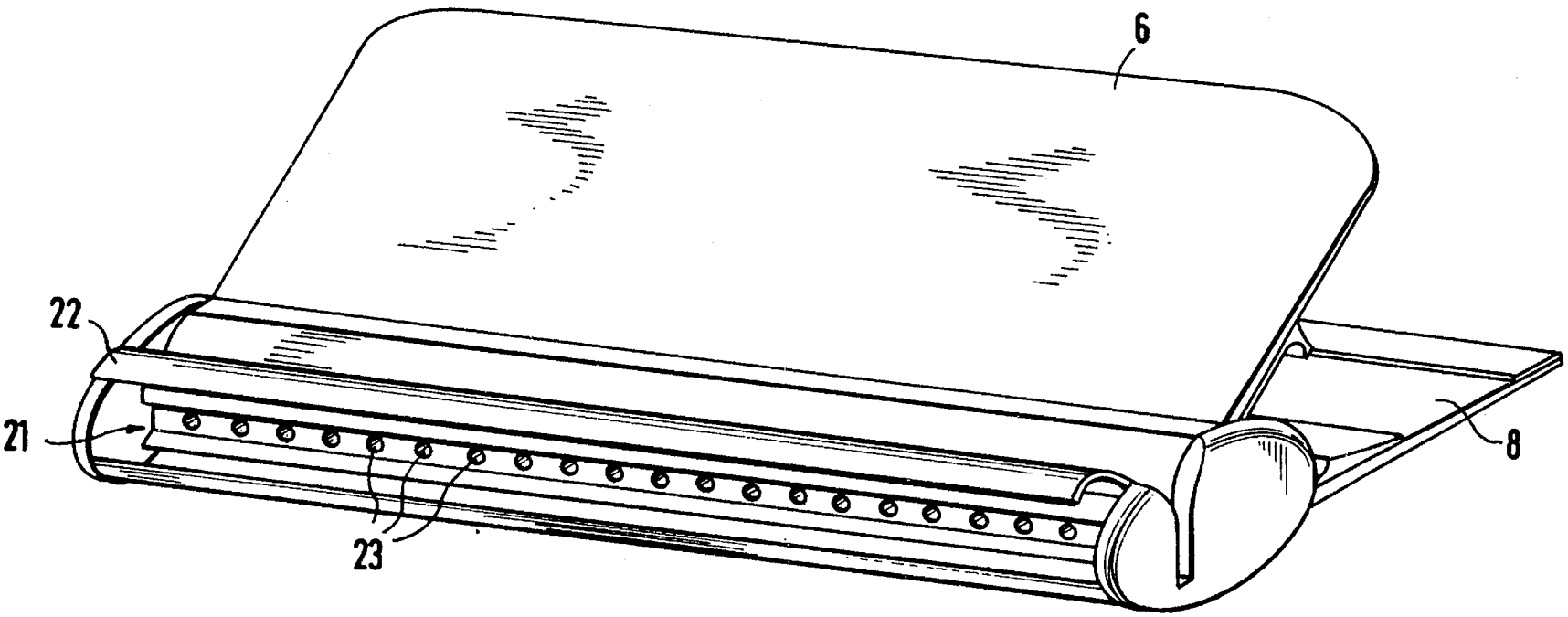
FIG. 4 shows a perspective view of the inventive binding equipment and punching device of FIG. 1 from a different side.

After the binding wire 10 has been bent and/or the stack 2 of sheets has been punched, the pressure lever plate 6, which has been moved against the force of one or several spring elements within the housing 1, is swiveled back through these spring elements into the initial position shown in FIGS. 1 or 4.

Figure 8:
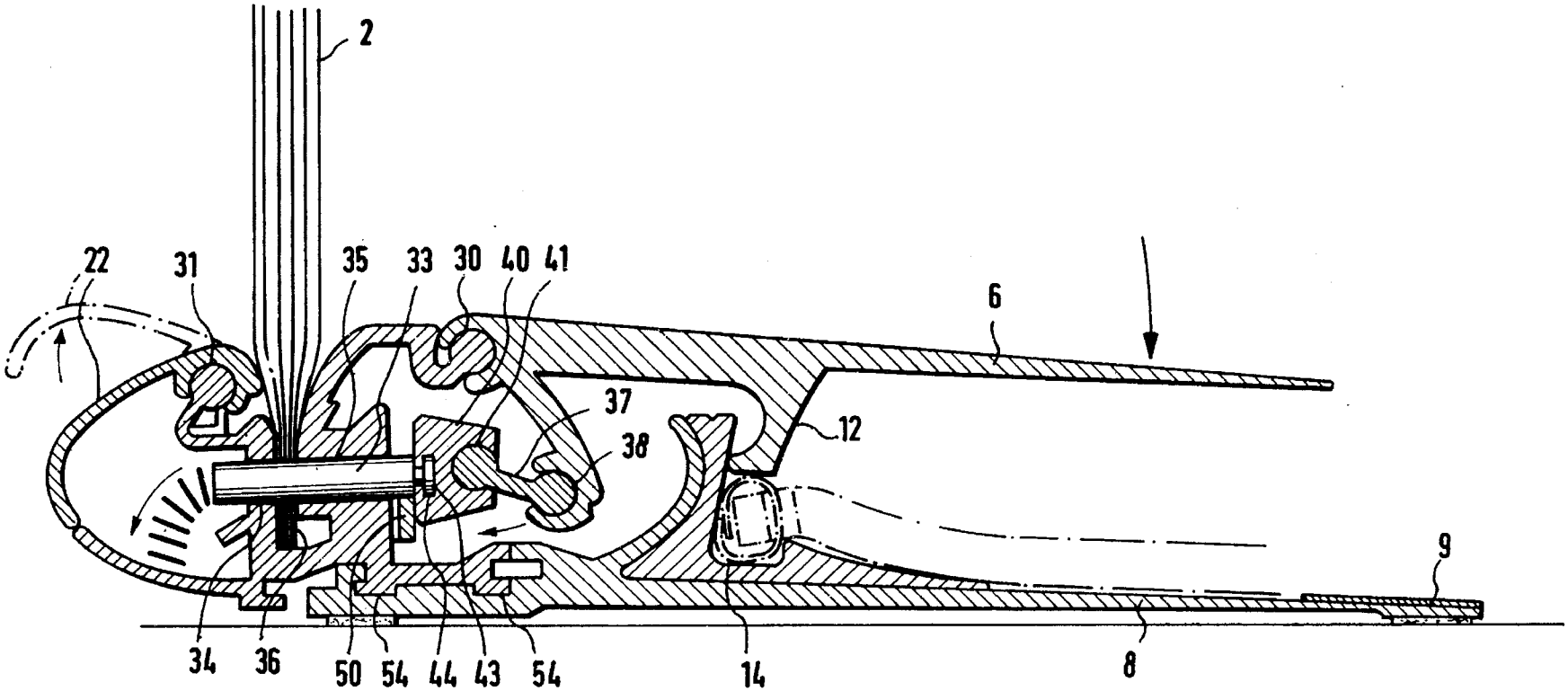
FIG. 8 is a cross-sectional view similar to FIG. 5 but showing the parts in a different position.

The pressure lever plate 6 is pivotably connected to the housing 1 at 30. The lid 22 is pivotably connected to the housing 1 at 31. In FIG. 8, the lid 22 is shown in solid lines in its closed position. The broken line position of the lid 22 in FIG. 8 shows its open position. The lid 22 can be opened to provide access to the parts and also for removing the punched-out material.

The housing 1 has internal passages at 33 and 35 to slidably support punching elements 33. The housing 1 has a slot 36 for receiving the sheets to be punched. The slot 36 is formed by two vertical walls and these two vertical walls are provided with the aforementioned passages 33 and 35 for the punch elements 33.

The pressure lever plate 8 pivotably supports a swivel element 37 as indicated at 38. A pivotal support member 40 is provided in the housing 1 and this pivotal support member 40 is pivotably supported on the swivel 37 as indicated at 41. The swivel support member 40 has an elongated slot 43. The slot 43 receives the heads 44 of the punching elements 33. It can be seen in FIGS. 5 and 8 that the heads 44 of the punching elements 33 have a narrow neck which is accommodated within a narrow part of the slot 43 so that the heads 43 are retained within the slot 43 as the punches 33 move back and forth to effect a punching action.

The swivel element 37 and the caps 3 may be made of a plastic material. The other parts may be made of metal such as aluminum.

Figure 5:
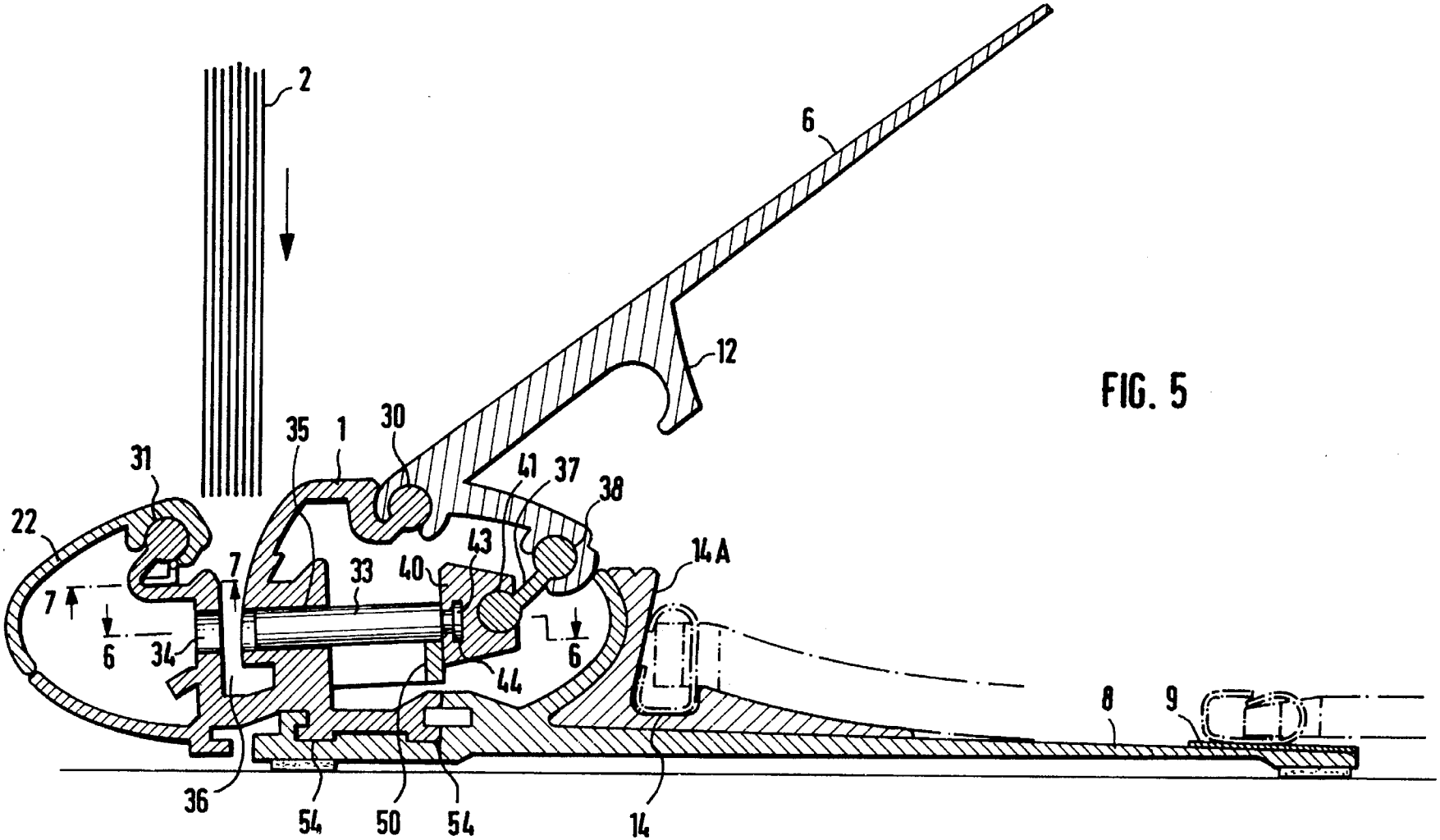
FIG. 5 is a cross-sectional view taken along the cutting plane 5—5 in FIG. 1.
Figure 6:
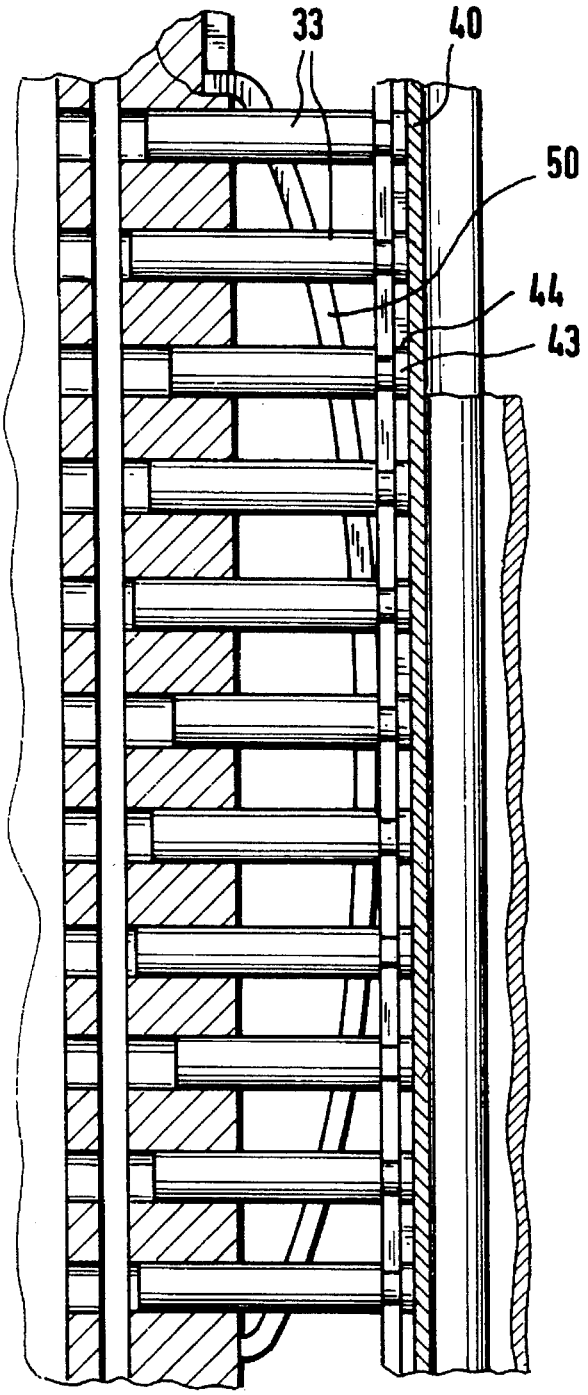
FIG. 6 is a partial cross-sectional view taken along the line 6—6 in FIG. 5.

It will be seen that when the pressure lever plate 6 is moved from the FIG. 5 to the FIG. 8 position that the holes will be punched into the sheets and simultaneously therewith, the binding of the binding wire will be effected.

As shown in the right hand portion of FIG. 5, the magnetic strip 9 can be utilized to retain the binding wire on the magnetic strip as the punched sheets are placed in position on the binding wire, that is the position on the binding wire as shown in FIG. 2, for example. When the pressure lever plate 6 is moved from the FIG. 5 to the FIG. 8 position, the projection 12 engages the binding wire to effect the binding of the sheets as previously explained.

The pressure lever plate 6 is biased towards an unactuated position shown in FIG. 5 by means of one or more leaf springs 50.

Figure 7:
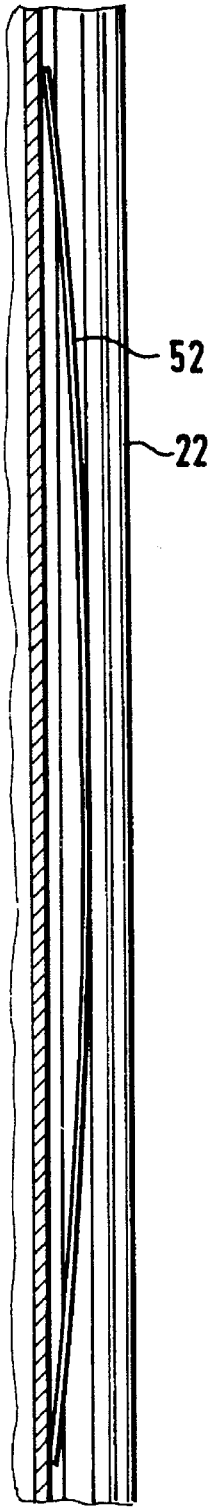
FIG. 7 is a partial cross-sectional view taken along the line 7—7 in FIG. 5.

The lid 22 is biased to its closed position shown in FIG. 5 by one or more leaf springs 52 shown in FIG. 7.

As will be seen from the drawings, the various parts may be made from extruded shapes and joined together by sliding them in a longitudinal direction such that the apparatus can be assembled without requiring any screws or other fasteners. FIG. 5, for example, shows the plate 8 having grooves 54 to slidably receive companion foot portions on the housing 1. FIG. 5 shows the base plate 8 formed separately from the part 14A which forms the accomodating groups 14. Alternatively, these parts 8 and 14A may be made integrally as a single part. As shown in the drawings, the lid 22 may be assembled on the housing 1 by sliding the lid 22 longitudinally as its semi-circular groove engages the cylindrical pivot support. Similarly, the base plate 6 can be assembled by sliding it longitudinally in position as will be readily seen in the drawings. Further, the swivel member 37 may be assembled by sliding it longitudinally within the respective pivot grooves. The swivel member 37 may be made of a plastic material so that it could flex a little when the plate 8 is moved from its unactuated position (FIG. 5) to its actuated position (FIG. 8).

What I claim is:

1. Apparatus for binding a plurality of sheets having aligned holes with a binding wire means comprising two bending elements which are pivotally connected to one another, one of said bending elements having a recess means for partially accommodating the binding wire means, the other of said bending elements having a projection such that upon placing the binding wire means in said recess means with the binding wire means passing through said holes in said sheets and effecting pivotal movement between said two bending elements, said projection engages and bends said binding wire means to thereby effect binding of said plurality of sheets by said binding wire means, said one binding element being designated a base plate means and said other binding element being designated a pressure lever plate, said pressure lever plate being pivotally mounted on said base plate means by pivot means, said pressure lever plate being pivotable between an unactuated position in which said projection on said pressure lever plate is spaced from said binding wire means as said binding wire means is disposed in said recess means and an actuated position in which said projection on said pressure lever plate engages said binding wire means as said binding wire means is disposed in said recess means to effect binding of said sheets by said binding wire means, a housing means joined to said base plate means, and punch means on said housing means operable to punch holes in said plurality of sheets, said pressure lever plate upon being pivoted from said unactuated position to said actuated position being operable to actuate said punch means to effect punching of said holes in said sheets.

2. Apparatus according to claim 1 wherein said binding wire means has an unbound configuration and a bound configuration, said binding wire means when in said unbound configuration having a plurality of open loops adapted to be passed through said aligned holes in said plurality of sheets, said binding wire means when in said bound configuration having said plurality of loops closed to thereby preclude removal of said plurality of sheets from said closed loops and thereby affecting binding of said plurality of sheets, said binding wire means being in said unbound configuration when said pressure lever plate is in said unactuated position, said binding wire means being in said bound configuration when said pressure lever plate is in said actuated position.

3. Apparatus according to claim 1 wherein said recess means comprises a groove, said binding wire means comprising an elongated wire element having a plurality of loops, said wire element having a width and length, said groove having a width and a length, said groove having a width and a length substantially equal to the respective width and length of said wire element.

4. Apparatus according to claim 1 wherein said projection has a generally L-shaped configuration.

5. Apparatus according to claim 1 wherein said projection has a generally mushroom configuration.

6. Apparatus according to claim 1 wherein said projection has a generally T-shaped configuration.

7. Apparatus according to claim 1 wherein each of said two binding elements have a plate-like configuration.

8. Apparatus according to claim 1 wherein said one bending element and said recess means are formed as one piece, said other bending element and said projection being formed as one piece.

9. Apparatus according to claim 8 wherein said projection is made of the same material as said other bending element, said recess means being made from the same material as said one bending element.

10. Apparatus according to claim 1 wherein said other bending element is pivotal about a pivot axis relative to said one bending element, said projection and said recess means being disposed in the immediate vicinity of said pivot axis.

11. Apparatus according to claim 1 wherein said projection is formed as one piece, further comprising first affixing means affixing said projection to said other bending element, said recess means being formed as one piece, and second affixing means affixing said recess means to said one bending element.

12. Apparatus according to claim 1 further comprising biasing means biasing said pressure lever plate toward said unactuated position.

13. Apparatus according to claim 1 wherein said one bending element is a base plate adapted to be disposed on a support surface, said base plate pivotably supporting said other bending element such that said other bending element pivots relative to said base plate.

14. Apparatus according to claim 1 further comprising a magnetic strip on said one bending element.

15. Apparatus according to claim 1 further comprising a magnetic coating on said one bending element.

16. Apparatus according to claim 1 wherein said housing means structurally interconnects said punch means and said binding apparatus.

17. Apparatus according to claim 1 wherein said apparatus is made from extruded metal parts without fastening screws.

18. Apparatus according to claim 1 wherein said punch means is operated to punch said holes simultaneously as said binding wire means effects binding of said plurality of sheets by said binding wire means.

19. Apparatus according to claim 1 wherein said binding wire means comprises a pivotal support means pivotably connected to said pressure lever plate, said punch means comprising punch elements, said punch elements being actuated by said pivotal support means.

20. Apparatus according to claim 19 wherein said punch elements are mounted on said pivotal support means.

21. Apparatus according to claim 1 wherein said housing means has a vertical slot for receiving sheets to be punched, said housing means further having a vertical wall, said punch means having elongated punch elements, said vertical wall having openings which slidably receive said elongated punch elements.

22. Apparatus according to claim 21 wherein said vertical wall is designated a first vertical wall, said housing means having a second vertical wall, said second vertical wall being spaced from said first vertical wall, said slot being formed between said spaced first and second vertical walls, said first vertical wall having a first upper extending part, said pressure lever plate being pivotably mounted on said first upper extending part, said second vertical wall having a second upper extending part, said housing means further comprising a lid movably mounted on said second upper extending part between open and closed positions.

23. Apparatus according to claim 19 further comprising rotatable support means rotatably supporting said pressure lever plate on said housing means for rotation about a rotatable axis, said pivotable support means being movable in a direction transverse to said rotatable axis.

24. Apparatus according to claim 19 wherein said pivotal support means comprises a swivel member and a punch actuating member, said swivel member being pivotably connected to said pressure lever plate, said swivel member being pivotably connected to said punch actuating member.

* * * * *